US006852917B2

(12) United States Patent
McAleenan

(10) Patent No.: US 6,852,917 B2
(45) Date of Patent: Feb. 8, 2005

(54) CONSTRUCTION AND METHOD OF WIND MUSICAL INSTRUMENT

(76) Inventor: Michael McAleenan, 44 Indian Point Rd., Georgetown, ME (US) 04548

( * ) Notice: Subject to any disclaimer, the term of this patent is extended or adjusted under 35 U.S.C. 154(b) by 0 days.

(21) Appl. No.: 10/271,210

(22) Filed: Oct. 15, 2002

(65) Prior Publication Data

US 2003/0070530 A1 Apr. 17, 2003

Related U.S. Application Data

(60) Provisional application No. 60/329,700, filed on Oct. 16, 2001.

(51) Int. Cl.[7] ..... G10D 7/00

(52) U.S. Cl. ..... 84/380 R; 84/382; 84/384; 84/385 R

(58) Field of Search ..... 84/380 R, 382, 84/384, 385 R

(56) References Cited

U.S. PATENT DOCUMENTS 3,561,905 A * 2/1971 Linton, Sr. ..... 84/380 R
4,998,456 A * 3/1991 Kahonen ..... 84/384
5,357,837 A * 10/1994 Disera ..... 84/383 R
6,242,678 B1 * 6/2001 Williams ..... 84/385 P

* cited by examiner

*Primary Examiner*—Shih-yung Hsieh
(74) *Attorney, Agent, or Firm*—Weingarten, Schurgin, Gagnebin & Lebovici LLP

(57) ABSTRACT

An associated method of construction and fabrication of organ windpipes and wind musical instruments utilizing composite materials. The fiber reinforced composite construction is a combination of fibers and resinous material. The fibrous material, maybe Carbon fibers, and/or Kevlar fibers, and/or Fiberglass fibers, and/or Wood Veneer(s) and/or core material, or any combination thereof, which is oriented and layered to create a laminate. The fibrous material can be pre-impregnated with a resinous material or impregnated with a resinous material. The acoustical resonance properties of the fiber reinforced composite wall material or laminate resonates with the generated pressure wave of the wind musical instrument, thereby providing improved tonal and acoustic performance.

The lightweight fiber reinforced composite wind instrument, produces richer and more brilliant tones, as well as multiple harmonics. In the preferred embodiment, there are minimal dimensional changes unfavorably affecting the musical sound qualities, such as shrinkage or elongation from adverse environmental conditions.

11 Claims, 3 Drawing Sheets

CONSTRUCTION AND METHOD OF WIND MUSICAL INSTRUMENT

CROSS REFERENCE TO RELATED APPLICATIONS

This Application claims priority under 35 U.S.C. §119(e) to Provisional Patent Application Serial No. 60/329,700 filed on Oct. 16, 2001, the disclosure of which is hereby incorporated by reference.

FIELD OF THE INVENTION

This invention relates generally to wind musical instruments, more particularly to the construction and method of organ windpipes and wind musical instruments.

BACKGROUND OF THE INVENTION

The present invention is directed to the construction and method of organ windpipes and wind musical instruments, wherein the improvements are a reduction in weight, as well as improved tonal qualities.

Wind musical instruments are generally made of wood and metal alloys. Some examples of wind instruments of the aforesaid type may, but are not limited to, the transverse flute, clarinet, saxophone, bassoon, oboe, and the piccolo.

Traditional wind instruments made of plastic, wood, or metal (including all metal alloys), or combinations thereof, result in instruments having an excessive damping of the harmonic response characteristics due to selection of the wall material and adverse environmental conditions. The wind instruments harmonic response characteristics are influenced by the interaction between the wind instrument wall material and the generated standing wave. This interaction between the wind instrument wall material and the generated standing wave can be viewed in terms of sound absorption. The sound absorption of the instrument is in direct relationship with the produced resonance of the instrument, of which provides the quality of the tones and sounds. It is known that by increasing wall material stiffness and reducing wall material density will have the effect of lowering the natural frequency at which the wall material will resonate. Use of composite materials for the walls of wind musical instruments will allow optimization of this high stiffness to low density ratio. Resonant wall optimization with the generated pressure wave of the wind musical instrument will improve tonal effects by providing richer and more brilliant tones, as well as multiple harmonics. It is also known that environmental changes in ambient moisture or humidity adversely influence the sound damping of the generated pressure wave from the wind musical instrument. It is known any dimensional changes may adversely affect musical sound qualities of the musical instrument by changing the geometric relationships of bore and tone hole (pitch determining holes) diameters resulting from shrinkage or elongation.

Wood musical instruments are prone to change dimensionally due to the affects on the wood from exposure from adverse environmental conditions, such as changes in ambient temperature, moisture, or humidity. Any dimensional changes will adversely affect musical sound qualities of the wood musical instrument by changing the geometric relationships of bore and tone hole (pitch determining holes) diameters resulting from shrinkage or elongation. Metal alloy wind musical instruments, such as the transverse flute and the saxophone are dimensionally unstable due to the affect of changes in temperature, which affect the high thermal coefficient of expansion of each respective metal alloy. An object of this invention is to provide a lightweight fiber reinforced composite wind instrument having a very low coefficient of thermal expansion producing a more dimensionally stable instrument over the prior art. The effects of an increased dimensionally stable instrument is the production of richer tones and sounds for the life of the instrument that would not be affected by changes in environmental conditions such as temperature.

Optimal construction and method of organ windpipes and wind musical instruments is important for obtaining a satisfactory sound from a wind instrument. For the musician to care for the present wind musical instrument, caution must be used in order to prevent exposure to adverse environmental conditions to maintain the instruments musical sound qualities. Age can have a negative effect on musical wind instruments, shortening the instruments' life due to the effect from extended long-term adverse environmental conditions. The weight of some metal musical wind instruments, such as the clarinet and saxophone can cause back and neck injuries from prolonged use of the instrument. There are devices known to aid with reducing the strain or injuries on the back and neck, but they tend to be bulky interfering with the musician's ability to play, thereby reducing the overall effectiveness for supporting the weight of the instrument.

Accordingly, it is an object of the present invention to improve the tonality of wind musical instruments by means of an associated method of fabrication and construction, in part utilizing composite materials.

Fiber reinforced composite wall materials for wind musical instruments will minimize damping over the life of the instrument, resulting in a wind instrument having significantly improved stable sound qualities over the prior art. Fiber reinforced composite wall materials for wind instruments may be exposed to adverse environmental conditions while experiencing minimal negative change in the instrument musical sound qualities, thus extending the life of the instrument. The fiber reinforced composite wall material or laminate of the present invention will resonate with the generated pressure wave of the wind musical instrument, of which will improve tonal effects. A lightweight fiber reinforced composite wind instrument with improved acoustical tonal performance, wherein producing richer and more brilliant tones, as well as multiple harmonics.

Still another object of the present invention is to provide lightweight wind musical instruments, that will reduce back and neck injuries from prolonged use of the instrument. This requires limiting the weight and therefore limiting the use of alloys traditionally used in the manufacture of wind musical instruments. Alloys could be used, but not limited to, critical joints, key-operating mechanisms, and/or for aesthetic value for any part of the instrument or organ windpipes. Changing colors of wind musical instruments and organ windpipes to meet demand and/or for aesthetic value will be optional.

SUMMARY OF THE INVENTION

In order to solve these problems, it is the object of the present invention to provide fiber reinforced composite construction of organ windpipes and wind musical instrument that provides improved tonality over the prior art. Fiber reinforced composite construction is a combination of fibers and resinous material. Fibrous material, such as but not to be limited to, Carbon fibers, and/or Kevlar fibers, and/or Fiberglass fibers, and/or Wood Veneer(s) or any combination thereof, is oriented and layered to create a laminate. The fibrous material can be pre-impregnated with a resinous material or impregnated with a resinous material. Pre-impregnated or impregnated resinous material, may include but not be limited to, thermoplastic resins and/or thermoset resins such as, polyester, vinylester, or epoxy. A laminate may be a single skin of fibrous resinous material or a sandwich composed of two skins and a core material. The core material can be any type of material.

The present invention includes a fiber reinforced composite wall material that provides a plurality of tonal improvements over the traditional wind musical instruments. Conventional wind musical instruments of wood or metal alloys have rigid cross sectional wall dimensions and therefore the tonal quality of the sound generated principally depends on geometry and craftsmanship, and not on resonate wall vibrations. Accordingly, fiber-reinforced materials, such as a composite of Carbon fibers, and/or Kevlar fibers, and/or Fiberglass fibers, and/or Wood Veneer, or any combination thereof, impregnated and/or pre-impregnated with a resinous material produce a lighter and stiffer structure than a conventional wood or metal alloy instrument. Stiffness of the structure depends on the selection and orientation of the fiber-reinforced material identified above, as well as the diameter and geometry of the wind musical instrument. For the wall composite laminate to resonate with the generated pressure wave of the wind musical instrument requires the consideration of many factors. Such as but not limited to, the optimization of the high stiffness to low density ratio, dimensional stability, wall thickness through modifications and changes in fiber material selection and core selection, laminate stacking sequence, fiber orientation, resinous material selection, manufacturing process selection, as well as the curing process selection. A composite wall thickness from 1/64 (0.0156) to 1/4 (0.25) inches insures minimal sound damping characteristics of the composite laminate body. In addition fibers oriented in relation to the longitudinal axis of the instrument from 0 degrees to plus or minus 90 degrees, insures optimal resonance qualities as well as structural requirements. The composite wall vibrations, coupled with the generated standing wave, provides a wind musical instrument with richer and more brilliant tones, multiple harmonics, along with a production of stable sounds not affected by changes in ambient moisture or humidity and/or temperature.

Another preferred feature of the fiber reinforced composite instrument is the plurality of advantages for having a lighter weight wind musical instrument. The weight of some metal musical wind instruments, such as the saxophone can cause back and neck injuries from prolonged use of the instrument. There are devices known to aid with reducing the strain or injuries on the back and neck, but they tend to be bulky, thereby reducing the overall effectiveness for supporting the weight of the instrument and affecting the musician's ability to play. The present invention reduces the likelihood of injury from prolonged use of the instrument, as well as eliminating the need for support devices for the instrument.

In accordance with another feature of the present invention is a method of fabrication of organ windpipes and wind musical instruments. This method of manufacture is adapted in particular for construction of a lightweight, fiber reinforced composite wall material for organ windpipes and wind musical instruments. Several methods of fabricating a lightweight resonating wall material are undertaken. Selection of the manufacturing process depends on the geometric considerations of the wind instrument. Fabrication techniques can be simple, cost effective, along with being time constrained in order to provide a molding process for an automated assembly of wind musical instruments. The molding process of this invention allows for the possibility of the integral molding of tone holes and pad seats for one-step construction of a composite wind musical instrument. Manufacturing processes of fiber-reinforced composites, such as but not limited to, a composite of Carbon fibers, and/or Kevlar fibers, and/or Fiberglass fibers, and/or Wood Veneer, and/or core material, or any combination thereof, impregnated and/or pre-impregnated with a resinous material will be selected based on the particular complex curvature of the instrument or organ windpipe. Complex curvature is a function of the geometry and bore diameter of the wind instrument. Selected manufacturing processes will therefore vary between wind musical instruments. A known composite manufacturing method will be selected for each instrument. Composite manufacturing processes identified may include but not be limited to filament winding and/or vacuum bag molding (vacuum assisted resin transfer molding) and/or resin transfer molding. Each manufacturing process involves using fiber-reinforced composites, such as but not limited to a composite of Carbon fibers, and/or Kevlar fibers, and/or Fiberglass fibers, and/or Wood Veneers, and/or core material, or any combination thereof impregnated and/or pre-impregnated with a resinous material, wrapped around a male mold or pressed within a female mold or placed into a resin transfer mold. Filament wound male mold of wrapped composite laminate can be, but not limited to, room temperature cured, ultraviolet (UV) cured or disposed in an oven at elevated temperature to cure. A vacuum assisted resin transfer male mold is disposed in a vacuum bag, while a female mold may either be disposed in a vacuum bag or positive pressure mold. Either a male or female vacuum assisted resin transfer mold may utilize hard or soft tooling and either be heated or placed in an oven. Resin transfer molding is a closed mold process utilizing "hard" or "soft" and/or heated tooling. Dry or impregnated fiber reinforcement is laid-up inside the mold and the mold closed. If dry fibers are utilized resin is injected into the mold or a resin film is placed into the mold prior to closing the mold. Vacuum and positive pressure utilized in the different manufacturing processes provides clamping pressure for the lamination as well as a pressure gradient for resin flow to impregnate the laminate. Individual fiber lengths range from particles to chopped fibers to continuous fiber lengths. Curing of the laminate is a property of the resinous material. Typically curing is a function of time and occurs at a temperature of say room temperature to 500 degrees Fahrenheit. Alternate curing resins such as but not limited to UV cured, use ultra-violet light instead of temperature.

DETAILED DESCRIPTION OF THE PREFERRED EMBODIMENTS

Figure 1:
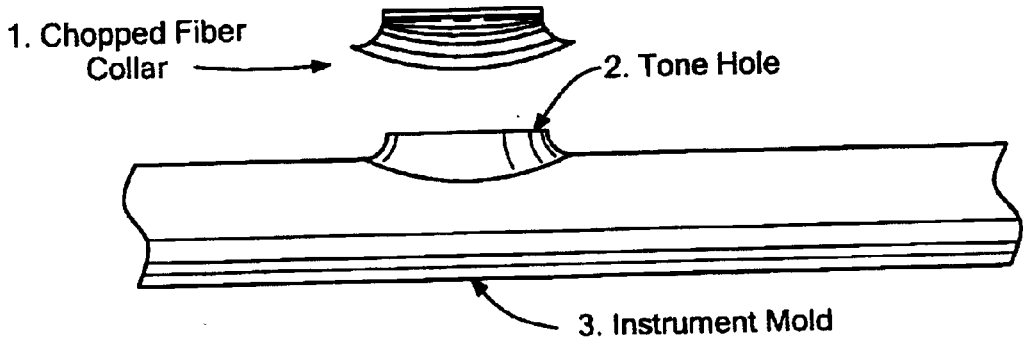
FIG. 1 shows, in cross section of the present invention, the zone of a hole of a transverse flute or of a saxophone surrounded by a chopped fiber reinforced collar.

The invention will be more fully understood from the following detailed description, in conjunction with the accompanying figures. Like or corresponding parts are denoted by like or corresponding reference numerals throughout views.

A known composite manufacturing method will be selected for each instrument. Composite manufacturing processes identified may include but not be limited to filament winding and/or vacuum bag molding (vacuum assisted resin transfer molding) and/or resin transfer molding. Regardless of the selected manufacturing process the steps necessary to produce a composite wind musical instrument are similar. The first step is to manufacturer a mold for the wind musical instrument following known mold making techniques. The mold is then prepped for lamination by applying mold release. This insures easy part separation after laminate curing. Fiber (impregnated or to be impregnated) is placed on the prepped mold at various orientations and layers depending on the organ pipe or wind instrument being manufactured. A majority of the wind instruments tone holes will be in situ molded. However there are a few tone holes, which will be difficult to mold integrally. Using the saxophone as an example, several tone holes will have chopped fiber collars manufactured and placed in the mold during fiber placement. In FIG. 1, a chopped fiber collar 1 rests above the zone of a tone hole 2 of a woodwind instrument male mold 3. This collar is either formed prior to fabricating the instrument as identified in FIG. 1, or is fabricated by the fiber reinforcement during the fabrication of the instrument. Depicted in FIG. 1, is a male mold, the process is similar for a female woodwind instrument mold. Wind instruments have several such tone holes 2 which can either have prefabricated tone hole collars 1 or in situ molded tone hole collars. The diameter of the tone hole 2 of a woodwind instrument determines whether a prefabricated tone hole collar 1 or an integrally molded tone hole collar is utilized.

Figure 1A:
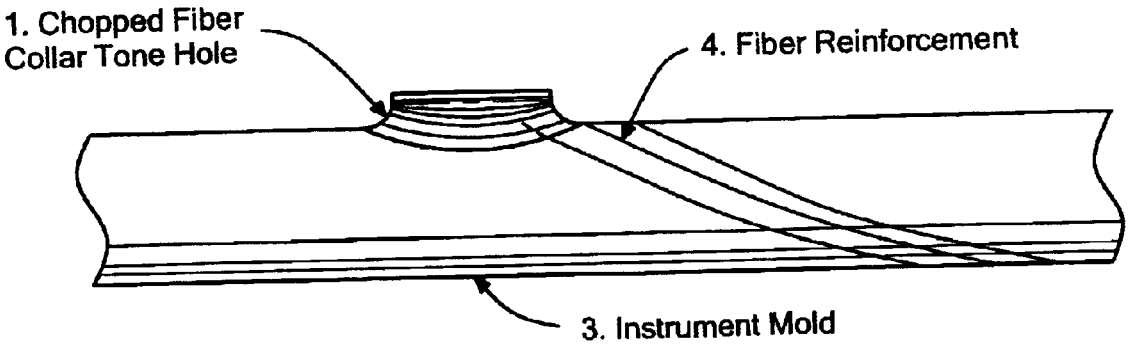
FIG. 1A shows, in cross section of the present invention, the placement of a chopped fiber reinforced collar in the zone of a tone hole of a transverse flute or of a saxophone.

Referring to FIG. 1A, a chopped tone hole collar is placed in the zone of a tone hole 1 of a woodwind instrument male mold 3. This collar 1 is either formed prior to fabricating the instrument as identified in FIG. 1, or is fabricated in situ by the fiber reinforcement during the fabrication of the instrument. A strip 4 of fiber reinforced composite material, such as but not limited to: a composite of Carbon fibers, and/or Kevlar fibers, and/or Fiberglass fibers, and/or Wood Veneer, and/or core material, or any combination thereof, impregnated and/or pre-impregnated with a resinous material, is wrapped around the male mold. In the zone of the tone hole, a strip of fiber reinforced composite material is applied prior to placement of the prefabricated tone hole collar 1. Depicted in FIG. 1A, is a male mold, the process is similar for a female woodwind instrument mold. Depending on the diameter of the tone hole an integrally molded tone hole collar can be utilized either on a male mold 3 or in a female mold. To integrally mold a tone hole collar during the fabrication process additional strips of fiber reinforced composite material are placed in the zone of a tone hole 1. The strip of fiber reinforced composite material 4 is formed of a single and/or multiple layers of uni-directional and/or cloth fibers, and/or core material, impregnated or to be impregnated with a resinous material making up a thickness of from 1/64 (0.0156) to 1/4 (0.25) inches.

Figure 2:
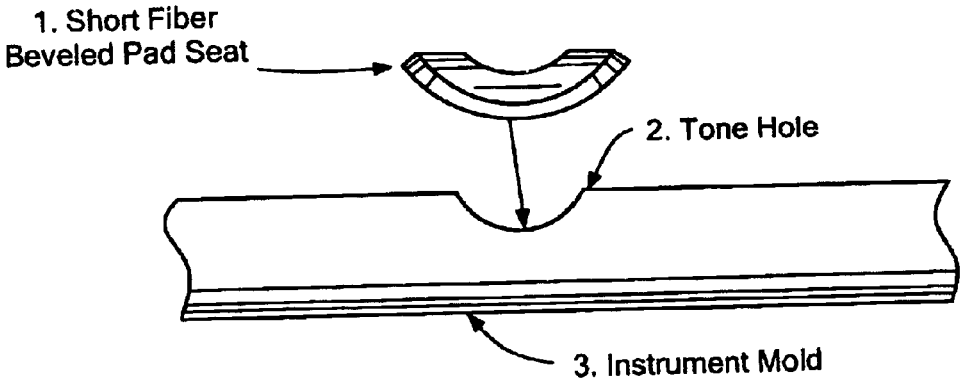
FIG. 2 shows, in cross section of the present invention, the zone of a hole of a woodwind instrument such as a clarinet, an oboe, a bassoon or a piccolo surrounded by a beveled zone.

In FIG. 2, a short fiber beveled collar 1 rests above the zone of a tone hole 2 of a woodwind instrument male mold 3. This collar is either formed prior to fabricating the instrument as identified in FIG. 2, or is fabricated by the fiber reinforcement during the fabrication of the instrument. Depicted in FIG. 2, is a male mold, the process is similar for a female woodwind instrument mold. Wind instruments have several such tone holes 2 which can either have pre-fabricated tone hole beveled collars 1 or in situ molded beveled tone hole collars. Beveled tone hole collars fabricated during the manufacturing process using a female mold require machining the female mold to accommodate the placement of additional material.

Figure 2A:
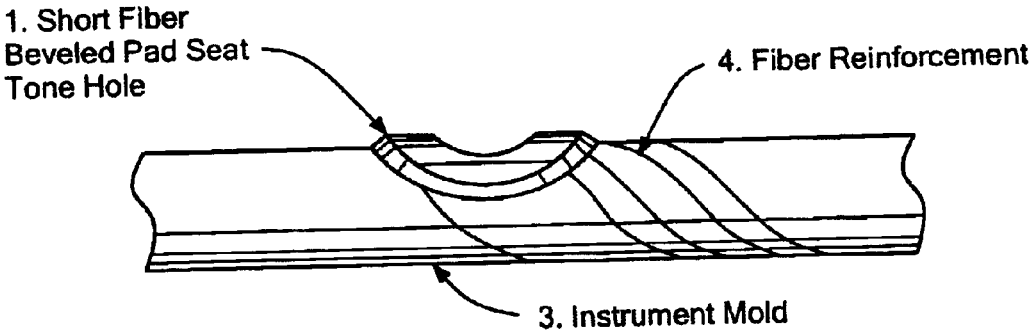
FIG. 2A shows, in cross section of the present invention, the placement of a chopped fiber reinforced beveled collar in the zone of a tone hole of a woodwind instrument such as a clarinet, an oboe, a bassoon or a piccolo.

Referring to FIG. 2A, a short fiber beveled tone hole collar is placed in the zone of a tone hole 1 of a woodwind instrument male mold 3. This collar 1 is either formed prior to fabricating the instrument as identified in FIG. 2, or is fabricated in situ by the fiber reinforcement during the fabrication of the instrument. A strip 4 of fiber reinforced composite material, such as but not limited to: a composite of Carbon fibers, and/or Kevlar fibers, and/or Fiberglass fibers, and/or Wood Veneer, and/or core material, or any combination thereof, impregnated and/or pre-impregnated with a resinous material, is wrapped around the male mold. In the zone of the tone hole, a strip of fiber reinforced composite material is applied prior to placement of the prefabricated short fiber beveled tone hole collar 1. Depicted in FIG. 2A, is a male mold, the process is similar for a female woodwind instrument mold. Depending on the diameter of the tone hole an integrally molded tone hole collar can be utilized either on a male mold 3 or in a female mold. To integrally mold a beveled tone hole collar during the fabrication process additional strips of fiber reinforced composite material are placed in the zone of a tone hole 1. The strip of fiber reinforced composite material 4 is formed of a single and/or multiple layers of uni-directional and/or cloth fibers and/or core material, impregnated or pre-impregnated with a resinous material making up a thickness of from 1/64 (0.0156) to 1/4 (0.25) inches.

Figure 3:
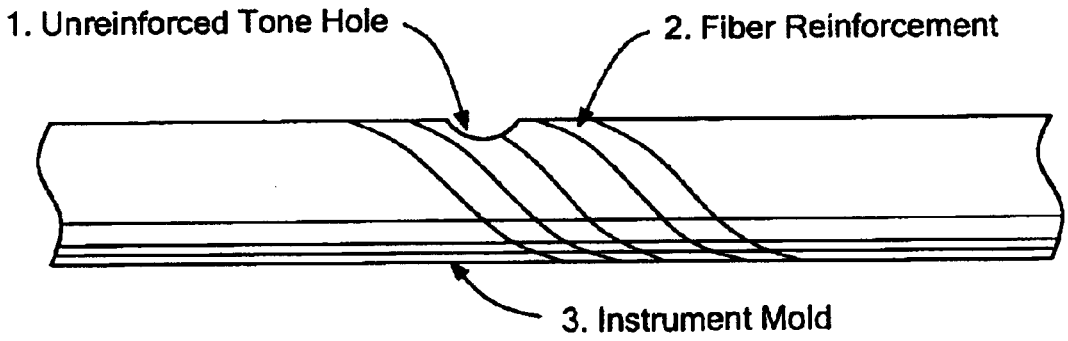
FIG. 3 shows, in cross section of the present invention, the zone of a small hole of a woodwind instrument.

In FIG. 3, no additional fiber reinforcement is structurally necessary in the zone of a small tone hole 1 of a woodwind instrument male mold 3. This small tone hole is fabricated by the fiber reinforcement 2 during the fabrication of the instrument. Depicted in FIG. 3, is a male mold, the process is similar for a female woodwind instrument mold. Wind instruments have several such small tone holes 1, which are fabricated by careful cutting and layering of the fiber-reinforced material 2 and/or careful machining following component manufacture.

Figure 4:
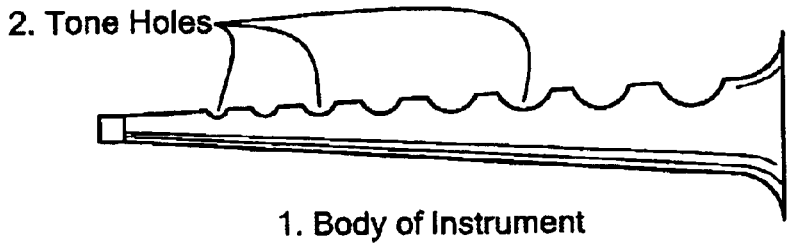
FIG. 4 shows, the body of a woodwind musical instrument.

In FIG. 4, a constant cross section or variable cross section tube 1, with tone holes 2, represents the body of a woodwind instrument.

Various modifications and changes are contemplated and may be utilized to achieve resonate wall vibrations. Optimization of the high stiffness to low density ratio, dimensional stability, and wall thickness through modifications and changes in fiber material selection, core material selection, laminate stacking sequence, fiber orientation, resinous material selection, manufacturing process selection and curing process selection may be resorted to without departing from the function or scope of the invention. Such optimization involves analytical analysis and testing of manufactured articles. An analytical analysis will begin with classical lamination theory to estimate the elastic constants of each isotropic and anisotropic laminate selected. Values of the estimated elastic constants, material density, and cross sectional geometry of the instrument being considered will be inserted into derived terms of the modified wave equation identified in Equation 1 below.

Equation 1: Modified Wave Equation $$\frac{1}{A(x)}\cdot\left(\frac{d}{d(x)}\right)\cdot\left[(Ax)\cdot\frac{d}{d(x)}\cdot Px\right]+\left[K^2-1i\,\omega\cdot\rho\cdot\left(\frac{Lper}{A\cdot Z}\right)\right]\cdot Px=0$$

Based on these analytical results, specific isotropic and anisotropic laminates will be selected for manufacture and testing. Testing involves determining the normal modes of the manufactured product. Testing is necessary due to complex geometric shapes, location/mass of pad/key structure and the estimated isotropic or anisotropic properties of laminates. An anisotropic laminate will have non-zero off axis stiffness and compliance matrix terms. If an anisotropic laminate is neither symmetric nor anti-symmetric the stiffness and compliance matrices will be fully populated and there will be more than two modes of coupling. In a symmetric or anti-symmetric laminate off axis terms are both zero and non-zero which exhibit two types of coupling, bend-twist coupling and extension-twist coupling respectively. One can design based on specific coupling parameters by varying stiffness terms, or by varying coupling parameters while maintaining stiffness values. For example two different lay-up configurations may end up with similar coupling parameters but different stiffness terms. Unfortunately such configurations are based on a trial and error approach.

Among the variations of the invention is the possibility to connect composite sections of a wind instrument with metal alloy joints such as at valves, holes, etc.

Although certain preferred embodiments of the present invention have been shown and described in detail, it should be understood that various changes and modifications may be made therein without departing from the scope of the appended claims.

What is claimed is:

1. A wind instrument having enhanced vibrational quality, stability and response comprising; a wind instrument having a composite laminate having a graduation in laminate thickness as at least a substantial part of a body; wherein said body includes at least a layer made of fiber reinforced composite material having a combination of fibers with or without core material and resinous material; said fiber reinforced composite material being selected from the group consisting of carbon fibers, kevlar fibers, fiberglass fibers, metal alloy fibers, or wood or other fibers, or any combination thereof, so as to create a laminate.

2. A wind instrument according to claim 1, wherein said composite laminate body includes a composite wall thickness of from 1/64 (0.0156) to 1/4 (0.25) inches, so as to provide minimal sound damping characteristics of said composite laminate body.

3. A wind instrument according to claim 1, wherein said composite laminate body includes a plurality of fibers oriented from 0 degrees to plus or minus 90 degrees from a longitudinal axis of said body, thereby to provide optimal resonance qualities and structural enhancements.

4. A wind instrument according to claim 1, wherein said composite laminate body has more than one detachable section.

5. A process for making the wind instrument according to claim 1, wherein said composite laminate body is made by filament winding, or vacuum bag molding, or resin transfer molding or any combination thereof.

6. A process for making the wind instrument according to claim 1, wherein said composite laminate body is made in a process including the integral molding of tone holes and pad seats for one step construction of an organ pipe or wind musical instrument.

7. The process of claim 6 further including the step of integral molding of a wind musical instrument tone hole surrounded by a collar.

8. The process of claim 6 further including the step of integral molding of a wind musical instrument tone hole surrounded by a beveled zone.

9. The process of claim 6 further including the step of integral molding of organ pipe baffles.

10. A process for making the wind instrument according to claim 1, wherein said composite laminate body is fabricated by integral insertion of tone hole collars or pad seats either before or after body formation of an organ pipe or wind musical.

11. A process for making the wind instrument of claim 1 comprising the step of forming said composite laminate in graded thickness.

* * * * *